US009283613B2

(12) United States Patent
Van Essen

(10) Patent No.: US 9,283,613 B2
(45) Date of Patent: Mar. 15, 2016

(54) INDEXING DIE SHOES IN A SWAGE PRESS

(71) Applicant: Betaswage Pty Ltd, Williamstown, Victoria (AU)

(72) Inventor: Frederick Van Essen, Willamstown (AU)

(73) Assignee: Betaswage Pty Ltd, Williamstown (AU)

( * ) Notice: Subject to any disclaimer, the term of this patent is extended or adjusted under 35 U.S.C. 154(b) by 332 days.

(21) Appl. No.: 14/120,420

(22) Filed: Oct. 31, 2013

(65) Prior Publication Data

US 2014/0331734 A1 Nov. 13, 2014

(30) Foreign Application Priority Data

Nov. 1, 2012 (AU) ..... 2012904756

(51) Int. Cl.
*B21D 41/00* (2006.01)
*B21D 39/04* (2006.01)

(52) U.S. Cl.
CPC ..... *B21D 39/046* (2013.01); *B21D 39/048* (2013.01); *Y10T 29/5367* (2015.01)

(58) Field of Classification Search
CPC .... B21D 39/046; B21D 39/048; B21J 13/025
USPC ..... 72/402
See application file for complete search history.

(56) References Cited

U.S. PATENT DOCUMENTS

| | | | | | |
|---|---|---|---|---|---|
| 3,461,710 | A * | 8/1969 | Luedi | B21D 53/16 | 72/372 |
| 4,306,442 | A * | 12/1981 | Schrock | B21D 41/04 | 29/237 |
| 4,696,085 | A * | 9/1987 | Sauder | B21D 39/046 | 29/237 |
| 4,887,451 | A * | 12/1989 | Hoff | B21D 39/046 | 29/237 |
| 5,634,367 | A * | 6/1997 | Yamada | B21D 15/02 | 72/370.01 |
| 6,718,814 | B2 * | 4/2004 | Bartrom | B21J 9/06 | 72/402 |
| 7,383,709 | B2 * | 6/2008 | Intagliata | B21D 39/046 | 29/703 |
| 7,856,861 | B2 * | 12/2010 | Van Essen | B21J 9/06 | 72/402 |
| 8,950,232 | B2 * | 2/2015 | Van Essen | B21D 37/00 | 72/702 |
| 2014/0331734 | A1 * | 11/2014 | Van Essen | B21D 39/046 | 72/402 |

* cited by examiner

*Primary Examiner* — David B Jones
(74) *Attorney, Agent, or Firm* — Alston & Bird LLP

(57) ABSTRACT

The specification discloses a swaging press (10) having an annular axially movable drive member (19) and a plurality of die shoes (16) cooperable with the drive member (19), the drive member (19) having at least one inwardly facing contact surface (22, 23) engageable with at least one outwardly facing segmented contact surface (24, 25) of each die shoe (16), the die shoes (16) being arranged as a die shoe set (17) whereby axial movement of the drive member (19) in a first direction causes the die shoes (16) of the die shoe set (17) to move radially inwardly during a swaging operation, the die shoes (16) and the drive member (19) being movable relative to one another about a rotation axis (29) after a single swaging operation or after a number of swaging operations.

17 Claims, 9 Drawing Sheets

INDEXING DIE SHOES IN A SWAGE PRESS

FIELD OF THE INVENTION

This invention relates to improvements in swage press design, particularly of swage presses of the so-called "conical" design. Swage presses may also be referred to as crimping presses and are commonly, although not exclusively, used to connect a cylindrical metal collar or "ferrule" onto a hose by reducing the diameter of the metal collar or "ferrule" by plastic deformation. The swaging or crimping process is normally performed at ambient temperature such that yielding of the metal requires somewhat higher radial forces than those that would be required if the metal collar or ferrule was heated.

BACKGROUND OF THE INVENTION

Conical swaging presses typically comprise a housing with an annular axially extending side wall, a front wall with a central opening to enable work to be processed to be introduced into a work zone located rearwardly of the front wall and inwardly of the annular side wall, and a rear wall at least partially closing the space between the front wall, the rear wall, and inwardly of the side wall. Arranged within the work zone are a plurality of die shoes disposed axially circumferentially spaced from one another defining a ring of die shoes. Each die shoe has a radial inner surface adapted to connect to a die element that, in use, engages a work piece (ferrule) during a swaging operation and a radially outer surface engageable with a piston member movable in the axial direction under the influence of hydraulic fluid applied pressure forces. The radially outer surfaces of the die shoes are shaped as a segment of a frustoconical surface or two or more segments of frustoconical surfaces each separated by a joining ramp surface whereby each segment of a frustoconical surface defines a segment of a circular cross-section in transverse cross-section. The piston member presents at least one internally formed frustoconical surface, or two or more such surfaces separated by ramp surfaces, when the die shoes are similarly formed. The inner surfaces of the piston member are designed to engage with the outer faces of the die shoes to force the die shoes radially inwardly as the piston member is forced forwardly during a swaging process. Movement of the piston member in a reverse direction allows the die shoes to move radially outwardly to allow a swaged work piece to be removed from the work zone. In one arrangement compression spring means operable between the die shoes assist with expanding the die set radially outwardly.

Typically, there is necessarily a mismatch between the radius of curvature of the outer faces of the die shoes and the frustoconical surface or surfaces of the piston member at axial positions along the die shoes such that there is axial line contact between the outer surface of the die shoes and the frustoconical surface(s) of the piston member when the press is unloaded, and a narrow axial contact band zone when the press is loaded. Because heavy loads are employed, it is necessary to lubricate the contact regions between the piston member and the die shoes. This is conventionally achieved by applying a suitable lubricating grease to the contact surfaces. With repeated swaging operations the lubricating grease tends to be squeezed towards the axial sides of die shoes progressively decreasing the amount of lubricating grease in the contact zone between the outer surfaces of the die shoes and the frustoconical surfaces of piston member. Generally, with repeated swaging operations, the contact lines or bands between the die shoes and the piston member remain substantially in the same circumferential region of the piston member frustoconical contact surfaces. Eventually, the operation of the swaging press has to be stopped and the press has to be serviced including re-greasing the above discussed contact surfaces. This puts the press out of use for a period of time. If re-greasing of the contact surfaces is not done when required, the press will become more and more inefficient and will eventually seize with potentially catastrophic effects. Attempts to overcome this problem have included using continuous supply liquid lubricants which provide problems and costs in the supply systems used for liquid lubricants and moreover, because of the heavy loads involved, liquid lubricants tend not to work as well as lubricating greases.

While conical type swaging presses are the most common swaging press design in use, it does have radial force limitations as well as the above discussed lubrication difficulties in operation. There has also been some development work in scissor design swaging machines but these machines tend to have a higher cost structure.

In this specification reference will be made to swaging presses and machines but this is intended to also incorporate reference to crimping presses and machines.

SUMMARY OF THE INVENTION

An objective of the present invention is to provide improvements in swaging machines that will overcome or substantially reduce problems associated with the lubrication of contact surfaces between the driving member and the die shoes.

Accordingly, the present invention provides a swaging press including an annular axially movable drive member and a plurality of die shoes cooperable with said drive member, said drive member having at least one inwardly facing contact surface engageable with at least one outwardly facing segmented contact surface of each said die shoe, said die shoes being arranged as a die set whereby axial movement of the drive member in a first direction causes said die shoes of the die set to move radially inwardly during a swaging operation, said die shoes and said drive member being movable relative to one another about a rotation axis after a single swaging operation or a number of said swaging operations.

A swaging press designed in accordance with the previous paragraph may, in operation, have lubricating grease applied to the contact surfaces between the drive member and the drive shoes. When the first swaging operation is conducted, grease will be forced laterally towards the axial edges of the die shoes, however, the second (or further) swaging operation(s) will occur with relative movement between die shoes and the drive member about the rotation axis, on a contact zone that will be lubricated by grease at least partially moved by the previous swaging operation or operations. As such, proper lubrication is continually maintained between the contact surfaces of the die shoes and the contact surfaces of the drive member. Thus re-lubrication of these contact surfaces is either avoided altogether or the period between re-lubrication of the contact surfaces is greatly extended compared with conventional conical type swaging presses.

Conveniently the segmented contact surface of each said die shoe is a segmented frustoconical surface. Conveniently, the contact surface or surfaces of said drive member are frustoconical surfaces.

In a preferred arrangement, the number of said swaging operations is a preset number greater than one. Conveniently the relative rotation about said rotation axis occurs through a predetermined angle. The predetermined angle may be between 1° and 10°, preferably between about 2° and 5°. Conveniently the predetermined angle may be about 2.5°.

Preferably, the die shoes move in the same direction about said rotation axis relative to said drive member. Preferably the rotation axis is coincident with an axis for axial movement of said drive member.

The swaging press may further include actuation means operable between said drive member and at least one said die shoe of said die set, said actuation means being activated by axial movement of said drive member during a said swaging operation to cause each said die shoe to move about said rotation axis. Conveniently, connection means may be provided to link the die shoes of said die set together whereby when said at least one die member is caused to move about said rotation axis, the remaining said die shoes also move about said rotation axis.

Conveniently, in one preferred embodiment, the drive member includes at least one annular ring surface, said annular ring surface including a ring of tooth formations, said actuation means including an element with a formed outer end positioned in a recess in at least one said die shoe and being urged in use, in a rearward direction towards said drive member, the formed outer end of the or multiple said element(s) being complementary in shape to the tooth formations of said ring of tooth formations on said drive member whereby axial movement of said drive member causes interengagement of a said element or multiple said elements with a respective said tooth formation of said ring of tooth formations to effect movement of the die shoes about said axis of rotation. Preferably said ring of tooth formations is located axially forward of said at least one frustoconical inwardly facing contact surface.

Conveniently, the swaging press may, in an alternative embodiment have guide formations formed in a forward end face of each of the die shoes, the guide formations having a generally radial disposition, some of said guide formations being substantially solely radial with at least one said guide formation having a portion that is at least partially peripheral in direction with one or more radial portions, a pair of thrust rings overlying said forward end faces, one of said thrust rings having axially extending pins each being engaged by a said substantially solely radial guide formation, the other of said thrust rings having at least one axially extending pin engaged by a said guide formation having a portion that is at least partially peripheral in direction, each of said thrust rings having a peripheral ring of ratchet teeth with a cooperating ratchet member restraining each said thrust ring to rotate only in one direction about said rotation axis.

Preferably each said guide formation may be a groove or slot formed in a said forward end face of a said die shoe. Conveniently, the die shoes are disposed such that said die shoes with substantially solely radial grooves or slots are interspaced by said die shoes with a said groove or slot with a portion that is partially peripheral in direction. The grooves or slots with a portion that is partially peripheral in direction has a Z format. Conveniently, at least some of said guide formations are grooves with a T cross-section, the axially extending pin adapted to cooperate with said groove with a T cross-section having a complementary pin and head shape.

BRIEF DESCRIPTION OF THE DRAWINGS

The annexed drawings show schematically prior art swaging machines and swaging machines incorporating aspects of the present invention to enable a better understanding of the invention. It will be understood that the invention is not limited to features shown in the drawings. In the drawings.

DETAILED DESCRIPTION OF THE EMBODIMENTS SHOWN IN THE DRAWINGS

Figure 1:
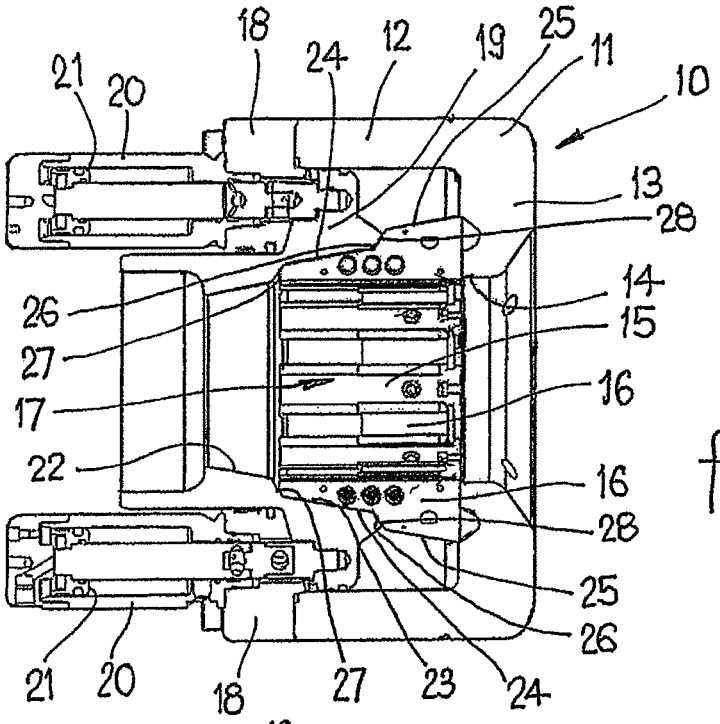
FIG. 1 shows in schematic cross-section a prior art cone type swaging press with the die shoes in a relaxed or withdrawn position.
Figure 2:
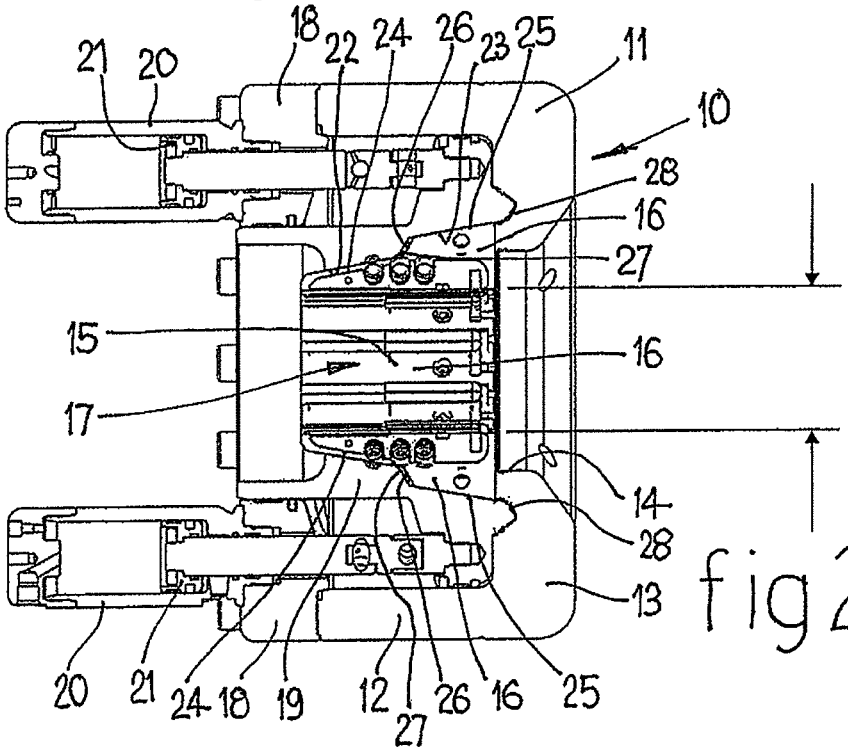
FIG. 2 is a view of the cone type swaging press of FIG. 1 showing the die shoes moved radially inwardly during a swaging operation.

FIG. 1 represents a prior art swaging machine or press 10 with a housing 11 comprised of an annular side wall 12, a front wall 13 with an access opening 14 leading to a work zone 15. A plurality of die shoes 16 forming a die set 17 circumferentially surround the work zone 15 within the side wall 12. The housing 11 includes a rear wall 18 connected to the side wall 12. In some known swaging presses, the front wall 13 is not integrally formed with the side wall 12 but is separately formed and connected to the side wall 12. A drive member 19 in the form of a piston is slidably mounted within the housing such that its outer wall slides on the inner surface of the housing side wall 12. In this embodiment, two or more hydraulic cylinders 20 with individual piston members 21 drive the drive member 19 towards the front wall 13 during a swaging operation. In other known swaging presses the drive member 19 is itself formed as a hydraulic piston and is moved forwardly by pressurized hydraulic fluid introduced in the cavity between the rear wall 18 and the piston (drive member) 19. FIG. 2 shows the drive member 19 in its forward most position adjacent the front wall 13 to contract the die shoes 16 inwardly to their minimum diametral dimension on completion of a swaging operation. This is achieved by frustoconical inwardly facing surfaces 22, 23 on the drive member 19 engaging outwardly facing segmental frustoconical contact surfaces 24, 25 on the die shoes 16 to wedge the die shoes inwardly as the drive member 19 moves axially toward the front wall 13. The contact surfaces 24, 25 on the die shoes 16 provide crimp planes with fast attack (or ramp) surfaces 26 immediately preceding the contact surfaces 25.

The efficiency and performance of this type of embodiment of swage press is subject to sufficient lubricity between the inner conical surfaces 22, 23 and the external contact surfaces 24, 25 of the die shoes. There is also a requirement of lubricity between the die shoes 16 and the front wall 13 but due to the nature of the design, the axial bearing force is much smaller than the radial force of the individual die shoes. In fact, the axial force is dependent on the lubricity of the radial bearing surfaces of the die shoes 16 and the inner conical arrangement of the drive member 19.

It can also be seen that by halting the progress of the drive member 19 in its forward motion, the resultant radial position of the die shoes 16 with attached tooling element "dies" will provide a resultant yielded metal/hose composite structure of required diameter. This is a requirement in the production of hose assemblies. The arrangement of the swage press with the drive member 19 halted at an intermediate position is possible to achieve a desired swaging diameter greater than the smallest diameter (shown in FIG. 2) with a particular die shoe set. The arrangement of the swage press with the drive member 19 halted at the extreme end position "closed position" to achieve the smallest achievable "swaging/crimping diameter" can be seen in FIG. 2.

During this process, the relationship between the "drive member inner frustoconical surface" and the "shoe external contact surface" at various "resultant swage diameters" varies during axial movement of the drive member 19. There is in fact a "conical curvature mismatch" at all stages of the swage/crimping process except for the fully "closed" position. Because the swage/crimping press is designed to halt at various "swage/diameters", the fully "closed position" is never quite achieved and serves more as a reference point from which various "offset distances" are referenced from to achieve a required "swage diameter".

The critical sliding surfaces between the "piston inner frustoconical surface" and the "shoe external contact surface" has "line" contact only. As radial load increases, there is deformation in both of the contacted elements resulting in deformation and the resulting "line" contact widening. The lubrication used to resolve the axial force transmitted by the drive member 19 into radial forces to the plural shoe elements is thus "extruded" away from "line contact" between the elements. The lubricant is extruded either side of the "line contact".

In subsequent operations, the contact area between the sliding surfaces will be subject to increased friction as more and more lubricant is extruded sideways. Unless there is continued application of lubricant between these surfaces, the efficiency of the "swage press" will be lowered or in a worst case scenario, seizure of the components and catastrophic failure.

Centralised automated lubrication systems have been installed in some machines to rectify this problem. The result in nearly all cases is an accumulation of lubricant build up into areas where the lubrication is ineffective. In some cases, dismantling of the "swage press" may be required to facilitate the removal of the lubricant residue build up. High load lubricants are very viscous in nature and the build up of residual grease can have detrimental effects on other aspects of the operation of the press. There are other methods involving lubricant with low viscosity, continuously pumped between the highly loaded bearing surfaces and the residue collected and then re-pumped back into these surfaces. This method requires lubricant that has low viscosity and is thus not suitable to high loadings of bearing surfaces which are becoming more common with present day swage presses.

Due to the limitations of the current design, manufacturers are tending to employ bearing surfaces that are self lubricated. These surfaces are not able to withstand the extreme loadings of that required in a typical "swage press" machine unless:

(i) The design is altered of the "load bearing interface" so that the contact is no longer "line contact" but full contact so that interface pressure is reduced.

(ii) The "swage press" radial related force is reduced.

(iii) The "swage press" is increased in size to maintain radial rated force. In general the cost of the "swage press" is increased dramatically from that of the basic art form.

In order to achieve continued lubricity between the two main bearing surfaces of the "swage press", and an improvement to the current art as depicted in FIGS. 1 and 2, the present invention provides a method of "indexing" the "shoes" in relationship to the "inner frustoconical arrangement" of the piston. When the lubricant is extruded either side of "line contact" of the bearing surfaces, the shoes are rotated slightly and in the subsequent operation, the "line contact" is "re-wetted" with lubricant. In this subsequent operation, lubricant is again extruded from the "line contact" of the bearing surfaces. Every subsequent operation will have the shoes rotated slightly in the same direction, and in each case a "re-wetting" will occur. Lubrication does not disappear and is extruded to areas where it will be used. This improvement in the design "chases" the lubricant and maintains the "swage press" in optimum and consistent efficiency. The possibility of seizure between highly loaded bearing surfaces is greatly reduced.

Figure 3:
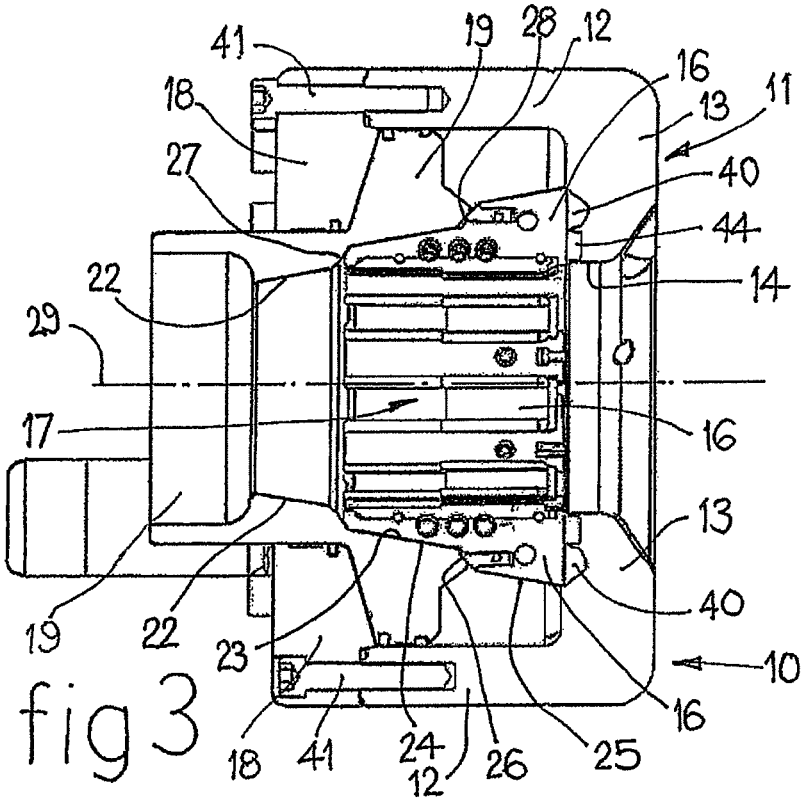
FIG. 3 is a schematic cross-sectional view of a modified swaging press incorporating features of the present invention.
Figure 4:
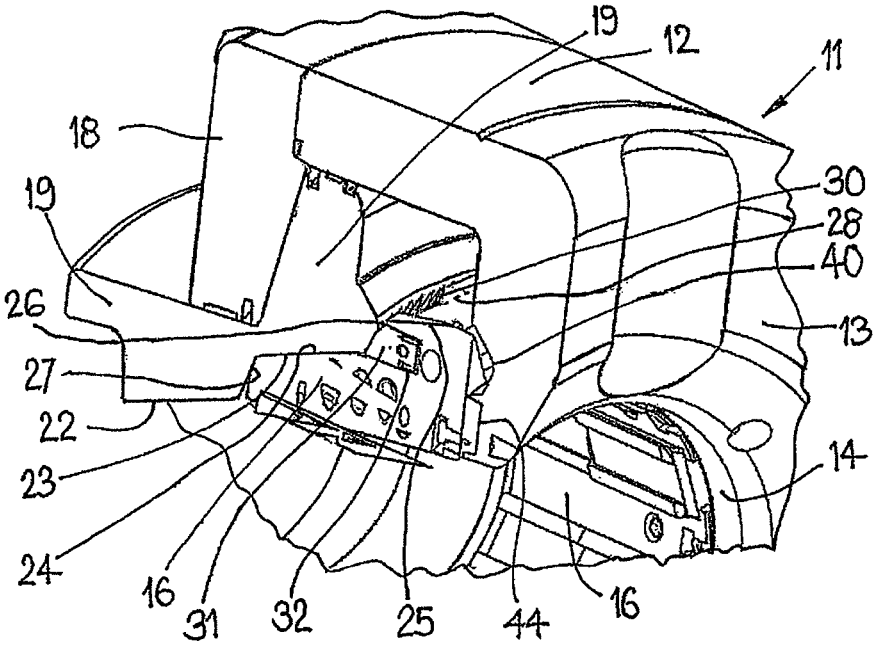
FIG. 4 is a partial perspective of a further cone type swaging press incorporating features of the present invention.

One preferred embodiment for achieving the process described above is illustrated in FIGS. 3 and 4, however, it will be understood that this is only one embodiment of achieving this method. In this embodiment, the drive member 19 is shown with a rear wall surface engaging a forward facing wall surface of the rear wall 18. To move the drive member 19 axially forwardly, pressurized hydraulic fluid is introduced into the space between the forward facing wall surface of the rear wall 18 and the rearwardly facing surface of the drive member 19. The rear wall 18 is secured to the annular side wall 12 by a plurality of spaced bolts 41. It will, however, be appreciated that the arrangement shown in FIGS. 1 and 2 could equally be used for driving the drive member forwardly. In a similar fashion to the swaging press shown in FIGS. 1, 2, the die shoes 16 have contact surfaces 24, 25 providing crimping planes and a fast attack planes or ramp surfaces 26 (as with FIG. 1). The drive member 19 includes a fast attack ramp 27 between the contact surfaces 22, 23 on the drive member 19. Indexing or rotation of the die shoes 16 about a rotation axis 29, is in this embodiment, achieved by introducing ring of gear teeth 30 having a skew gear tooth profile with buttress form on a ring ramp surface 28 on the drive member 19 forwardly of the frustoconical contact surface 23. In the foremost axial position of the drive member 19, the forward ring ramp surface 28 carrying the ring of gear teeth 30 is positioned in an annular recess 40 in the housing front wall 13. The skew gear tooth profile with buttress form 30 is intended to refer to a tooth profile that has inclined planes meeting at a ridge line, the inclined planes having relatively steeper and shallower slopes approaching the ridge line, with the ridge lines being bevelled or angled relative to the rotation axis 29. A spring loaded skew tooth element with buttress form 31 is provided on each die shoe 16 located in a recess 32 in the fast attack ramp surface 26 such that the spring loading tends to urge the element 31 outwardly and rearwardly in a generally axial direction relative to the recess 32. The buttress form of the outer end of each element 31 means that it is complementary in shape to the form of the gear tooth profile 30 on the drive member 19. It is relatively normal for cone type swaging presses to have eight die shoes 16 in the die set, however, other numbers of die shoes can be used. It is, however, desirable that the quantity of the skew gear teeth in the gear teeth ring 30 on the ramp surface 28 be a function of the number of die shoes 16 (i.e. eight in this embodiment). Preferably, the number of skew gear teeth in the ring 30 is a complete integer multiple of the number of die shoes 16 in the swaging press.

As the drive member (piston) 19 moves forwardly, the die shoes 16 move radially inwardly at a rapid rate. During this process, the frustoconical form of the drive member 19 initially only lightly loads the die shoe segmental frustoconical shaped contact surfaces. Control of the swage press 10 precludes the possibility of high bearing loading during this process. As the elements 31 are engaged with one of the cavities of the skew gear tooth profile with buttress form 30 of the drive member 19, forward motion of the drive member 19 causes the elements 31 and therefore the die shoes 16 to rotate slightly about the rotation axis 29. In this embodiment, rotation is by about 2 (two) degrees.

Figure 7:
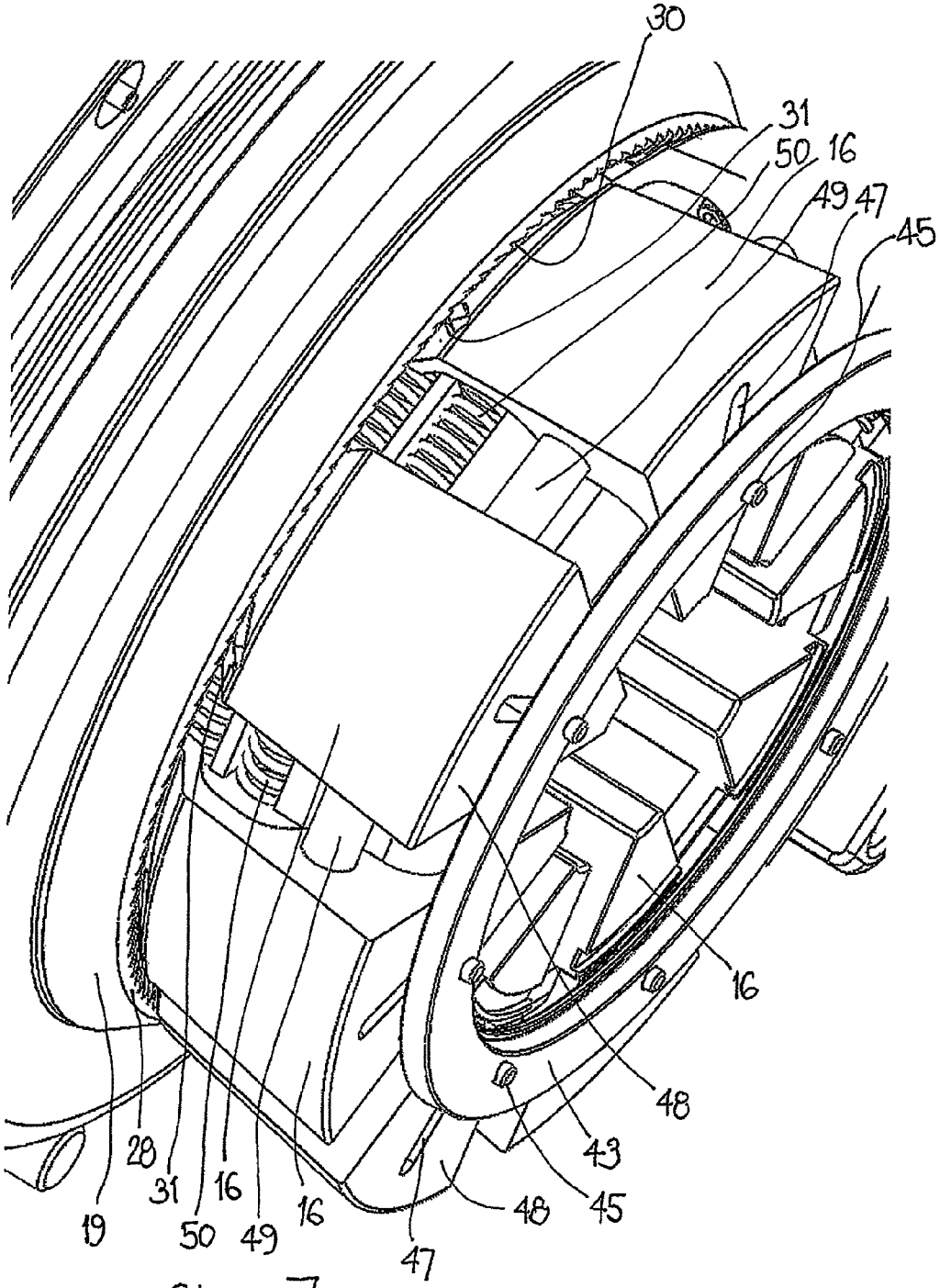
Figure 8:
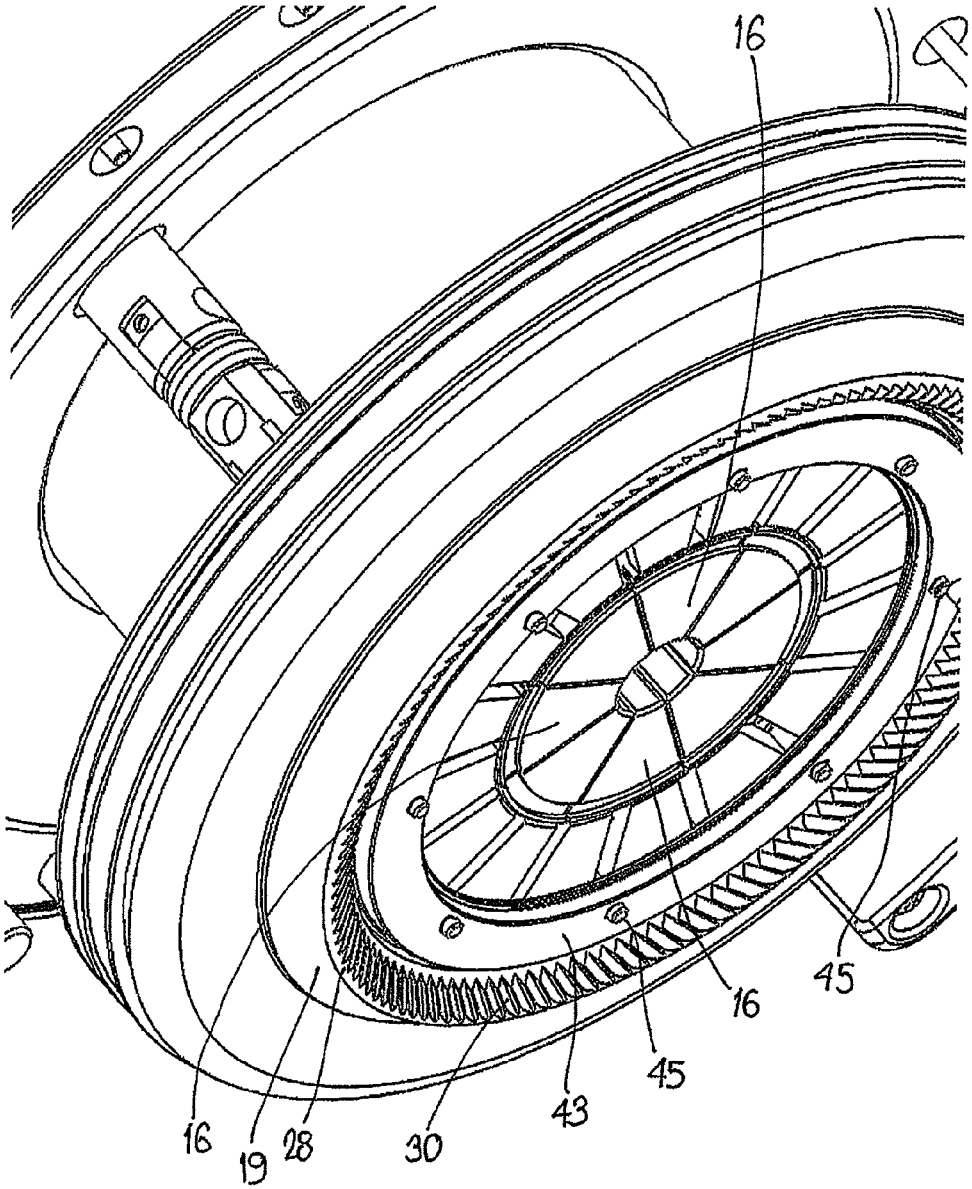
FIG. 8 is a perspective view similar to FIGS. 5 to 7 but with the die shoes moved fully inwardly to a crimping or swaging position.

Continued forward motion of the drive member 19 causes bearing contact between the crimping contact surface 23 of the drive member 19 and the contact surfaces 25 of the die shoes 16 achieving swaging of a work piece (FIG. 7). The crimp plane part of the cycle is where the swage press 10 is enabled to provide rated force to achieve the required compression of the work piece. After the process has been halted to achieve a desired compression/diameter, the drive member 19 then moves rearwardly causing the die shoes 16 to release the work piece with the die set increasing in diameter. When the ramp surfaces 26, 27 engage, the die shoes open more rapidly. In this position also the elements 31 re-engage with the cavities of the skew gear tooth profile 30. Reverse motion of the drive member 19 applies an opposite tangential force than was the case when the drive member 19 moved forwardly. As the corresponding meshing tooth form on element 31 and a cavity of the skew gear profile 30, is of buttress form, the skew angle now applies reactive tangential force that is now more resolved in an axial component. Each of the individual elements 31 now move inward into the shoe recess 32 and relocate into the next adjacent cavity of the skew gear profile 30 of the drive member 19. Forward motion as would be required for a subsequent swaging operation, would again rotate the die shoe set 17 by a further predetermined angle (about 2 degrees) while in the fast attack mode of the cycle. This then repositions the line contact of the die shoes 16 with the contact surfaces of the drive member 19 in a lubricant wetted region.

Figure 5:
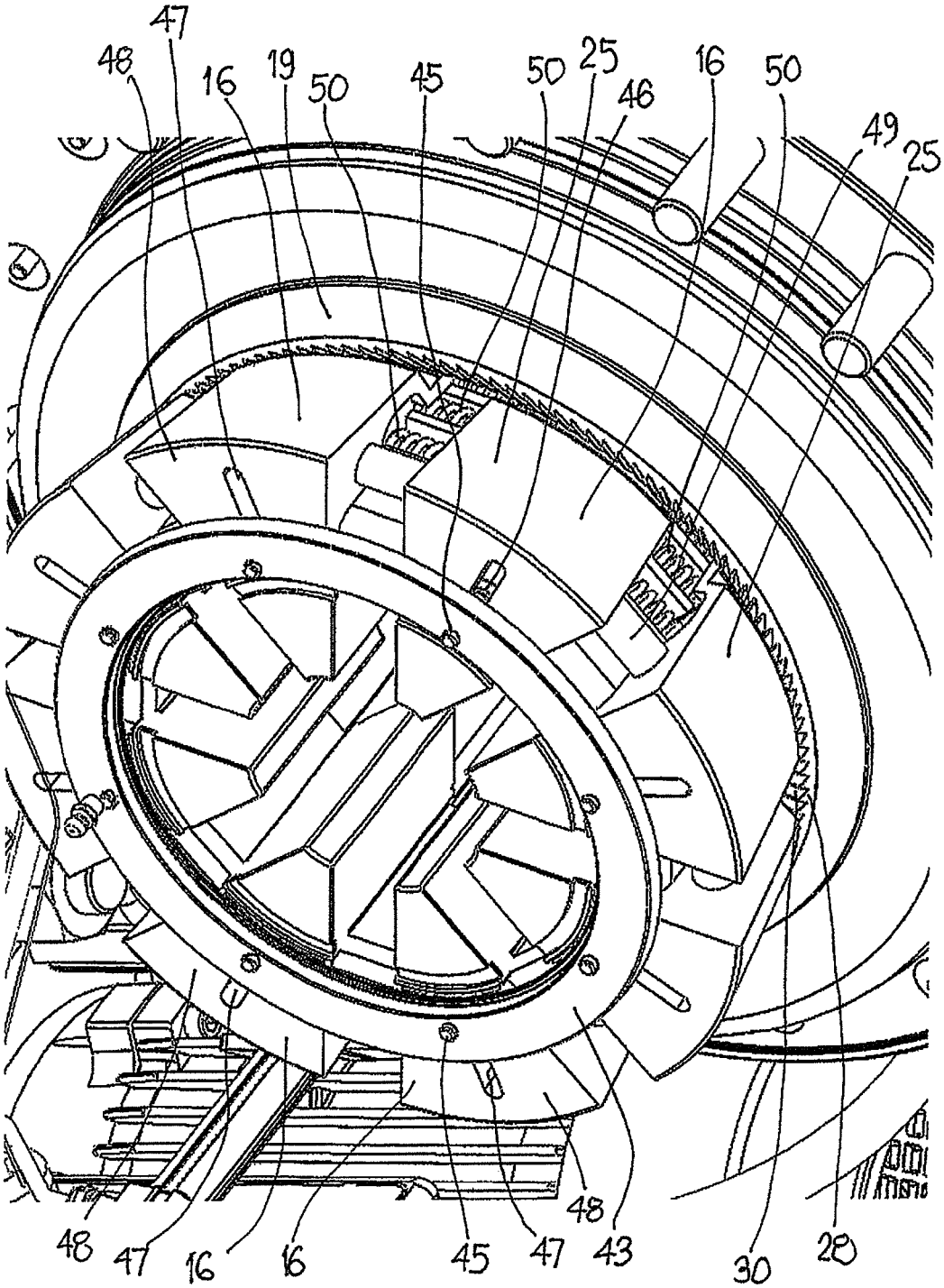
FIG. 5 is a partial perspective view of a further preferred embodiment of a swaging press according to the present invention with the outer housing removed for the sake of clarity.
Figure 6:
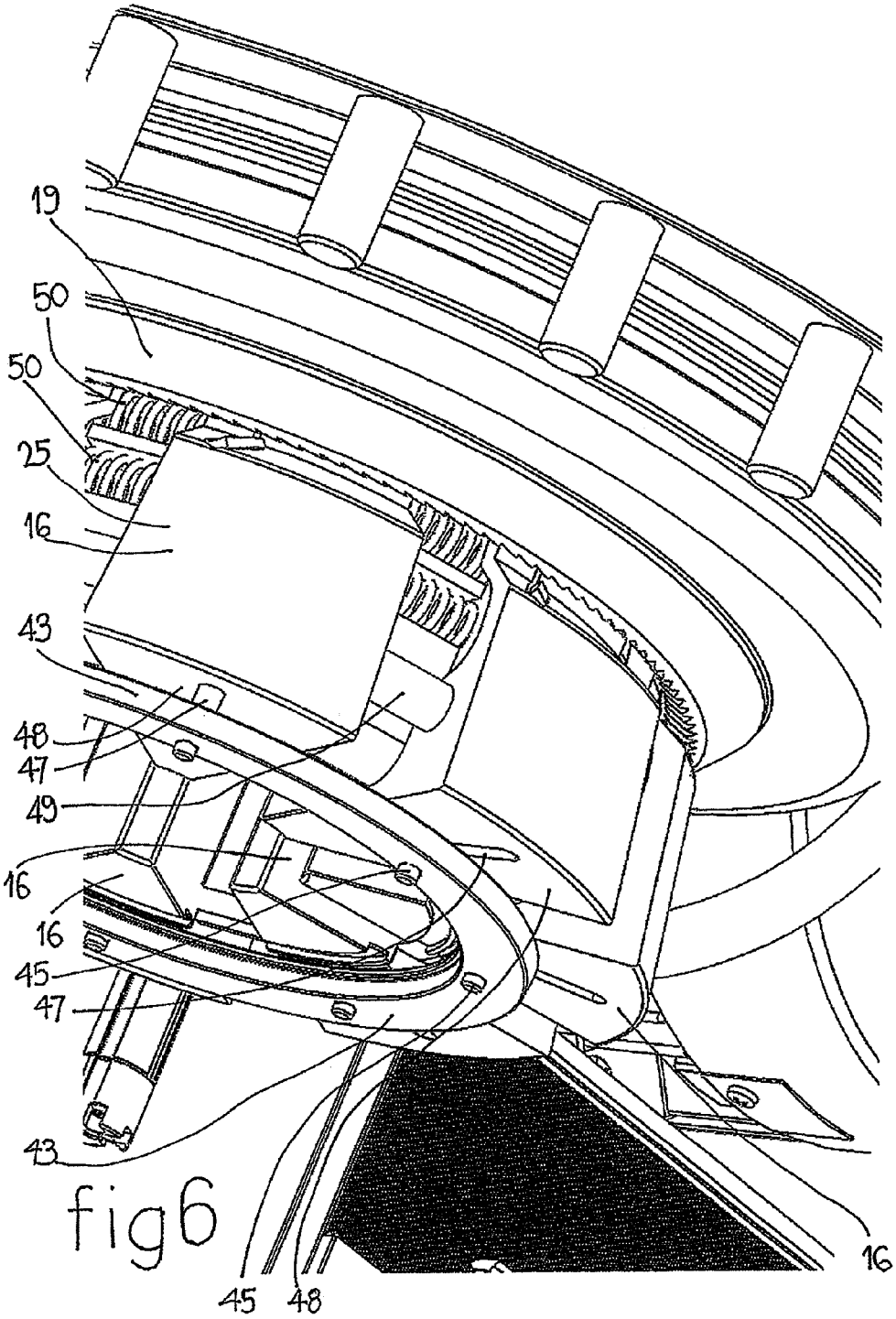
FIGS. 6 and 7 are partial perspective views of a swaging press according to the present invention similar to FIG. 5 taken from different angles.

FIGS. 5 to 8 illustrate further features of a swaging press incorporating aspects of the present invention. FIG. 5 shows the die shoes 16 linked together by a slide and thrust ring 43. The ring 43, when assembled with the housing 11 (not shown in FIG. 5), is located in an annular recess 44 in the front wall 13 of the housing 11 whereby the ring 43 can slidingly move in the recess 44. The ring 43 has equally spaced bolt members 45, each with a retaining head 46 and received within a radial slide slot 47 formed in the forward faces 48 of the die shoes 16. The slide slots 47 and bolt members 45 retain the die shoes 16 as a connected set whereby when the die shoes 16 are caused to rotate about the axis 29 by interengagement of the elements 31 with the gear teeth of the gear teeth ring 30, they do so as a set connected together. Further the slide slots 47 and bolt members 45 allow the die shoes 16 to move radially inwardly during a swaging operation and to relax radially outwardly on completion of a swaging operation. Also slide rod members 49 and compression springs 50 assist in maintaining circumferential positioning of the die shoes 16 with the springs 50 also assisting the die shoes 16 to move to a fully relaxed or withdrawn position upon completion of a swaging operation.

Figure 9:
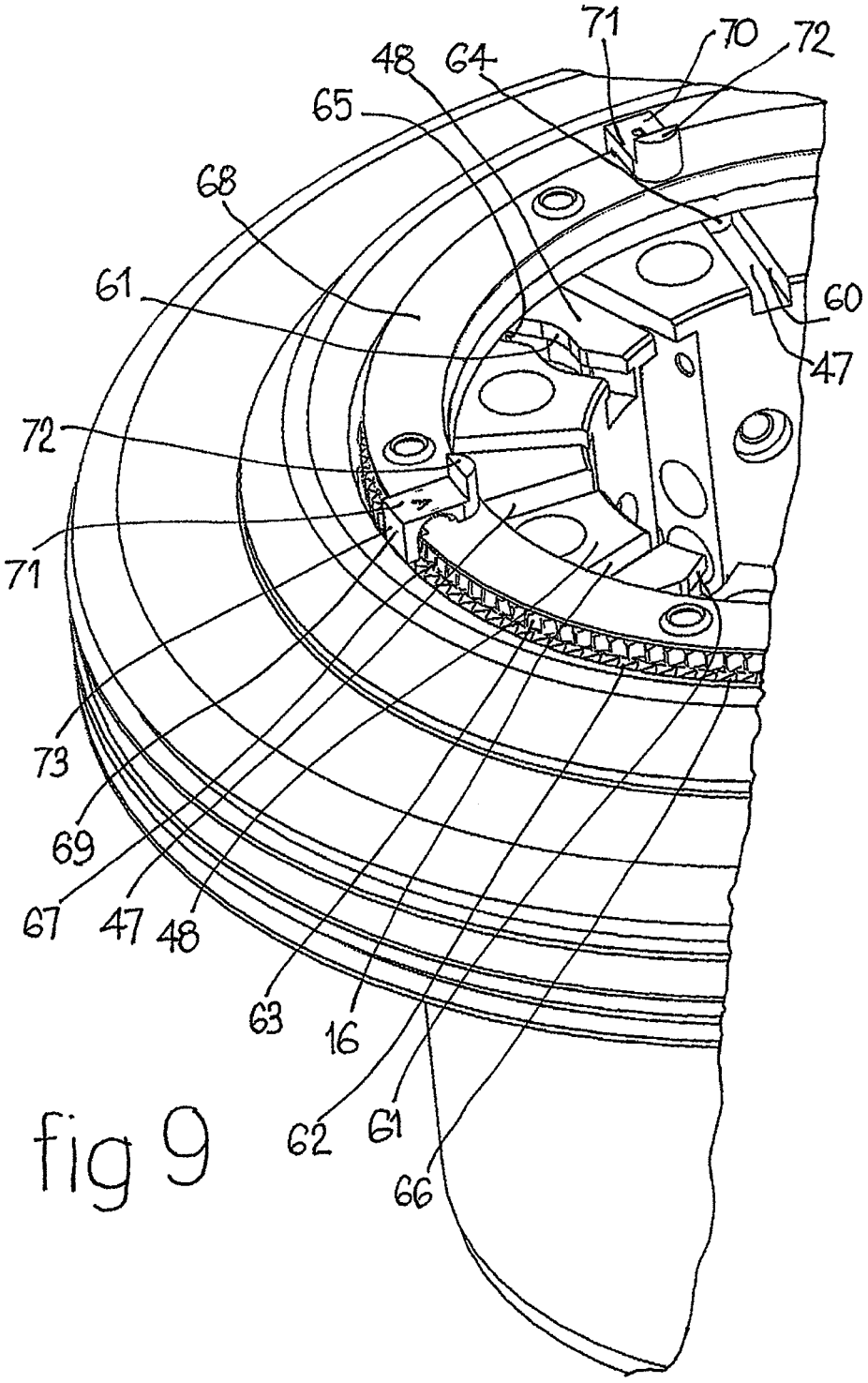
FIG. 9 is a partial front perspective view of a still further preferred embodiment of a swaging press with the outer housing removed for the sake of clarity.
Figure 10:
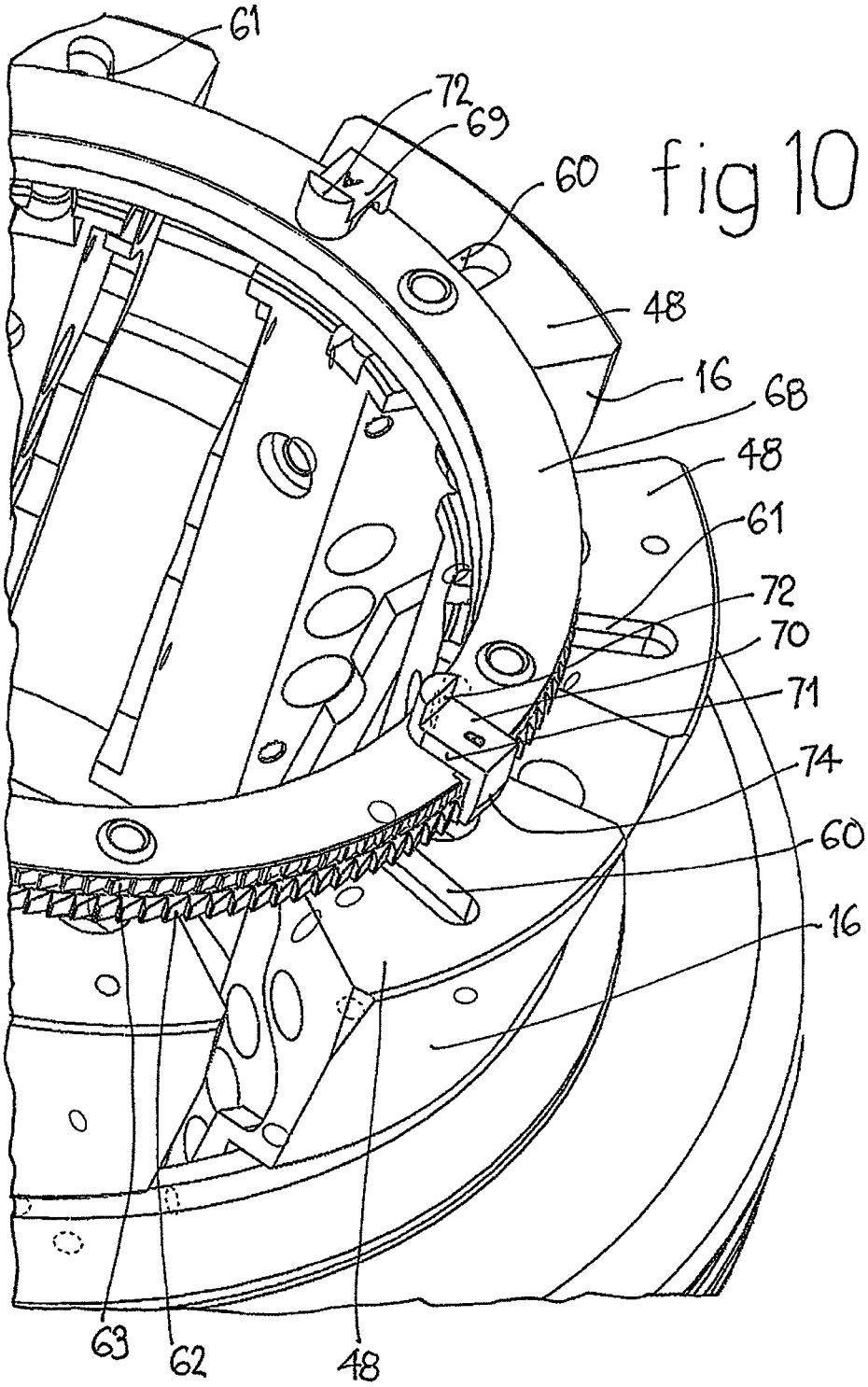
FIG. 10 is a partial front perspective view of the embodiment shown in FIG. 9 taken from a different angle.
Figure 11:
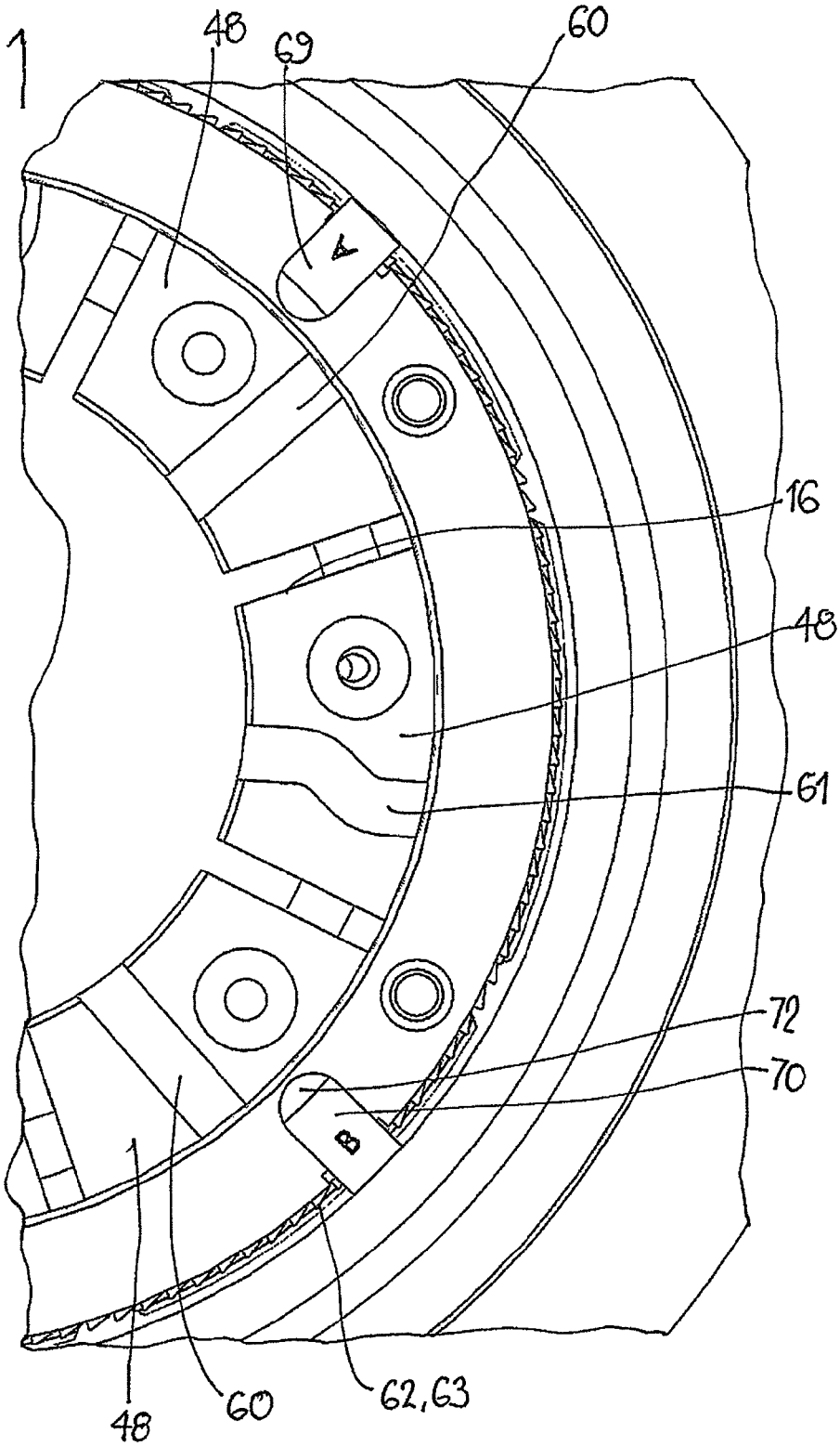
FIG. 11 is a partial front plan view of the embodiment shown in FIGS. 9 and 10.

Referring now to FIGS. 9, 10 and 11, a further embodiment of the present invention is shown. In this embodiment the ring of gear teeth 30 and the spring loaded element or elements 31 are omitted and replaced by a further mechanism for the desired rotation of the die shoes about the rotation axis 29 in the same direction. In this embodiment each of the forward end faces 48 of the die shoes 16 has a generally radial extending slot 47 formed therein. In this case every second slot 47 has a radial format 60 whereas the die shoes intermediate each die shoe with a radial slot 60 has a Z-form radial extending slot 61 formed in the end face 48 of the die shoe 16. The Z-form provides slot sections that are generally radially spaced by a slot section that has a degree of sideways or circumferential direction.

In addition to the above, two thrust rings 62 and 63 are provided overlying the forward end faces 48 of the die shoes 16. The first thrust ring 62 most adjacent the die shoe end faces 48 has axial pins 64 secured to the ring 62 and extending towards and slidingly engaged in the purely radial formal slots 60 in the die shoe end faces 48. The axial pins 64 are generally equally spaced about the circumference of the ring 62. Located generally between the axial pins 64 are separate discrete arcuate slots to permit a respective axial spaced pin 65 secured to the axial outer thrust ring 63 to pass therethrough with a free end of the pin 65 being received in a Z-form radial slot 61. As shown in the drawings, the Z-form radial slot 61 has a T-shape in cross-section with the cooperating pins on the thrust ring 63 having a complementary shaped head. Because the die shoes 16 are coupled together by pins and springs operating in the spaces between the respective die shoes, the headed pins and cooperating T-shaped slots 61 cause the thrust rings 62, 63 and the die shoes 16 to be coupled together as a subassembly or die set subassembly 17.

Each of the thrust rings 62, 63 have a complete ring of ratchet teeth 66, 67 around their peripheral edges. A third ring 68 is provided as part of the housing (not shown in FIGS. 9, 10 and 11) and overlies the thrust rings 62, 63. Further peripherally spaced ratchet engagement members 69, 70 are provided, each having a radial part 71 overlying the third ring 68 and an inner upstanding abutment wall 72. A radial compression spring (omitted from the drawings) urges the ratchet engagement members 69, 70 in a radially inward direction. Each of the members 69, 70 are held within the housing (not shown) except that they are capable of limited radial movement under action of the spring in a radially inward direction and limited radially outward direction under action of the ratchet teeth. Each of the ratchet engagement members 69, 70 has a radial outward and downwardly depending flange 73, 74 having inwardly directed formations to engage with ratchet teeth on one of the thrust rings 62, 63. The member 69 is adapted to engage with the ring 63 and the member 70 is adapted to engage with the ring 62. The members 69, 70 via the ratchet formations constrain the rings 62, 63 to rotate only in one direction.

As the piston drive member 19 is moved axially during a swaging operation towards the front of the swaging press, the die shoes 16 are moved outwardly. The Z-form slots 61 have a first radial section to ensure that the die shoes 16 move radially initially with the side ways section causing lateral side ways or peripheral movement. During heavy loading of an actual swaging or crimping stage of the press, the slots 61 are radial. The described structure allows the rings 62, 63 to move relative to one another and to effectively rotate about the rotation axis in one peripheral direction only whereby the die shoe set is similarly rotated through a predetermined angle, typically 2.5°.

The advantages achieved by the present invention include
(i) that the swage press is continuously lubricated without build up of excess lubrication when compared to a machine might be equipped with an automated lubrication system;
(ii) that the bearing surfaces can be produced in high alloying steels utilizing high pressure/high viscosity lubricants achieving bearing interface loads in excess of 100,000 psi;
(iii) that the design of the swage press is simple and economical to produce;
(iv) that the swage press can be smaller and lighter than machines of equivalent rated radial force than those produced with self lubrication bearing surfaces;
(v) that efficiency of the swage press is more consistent;
(vi) that light duty swage presses will be lubricated for life and heavier duty swage presses will require only a small application of lubricating grease between adjacent die shoes with much longer periods between such actions;
(vii) that grease nipples can be eliminated from the swage press design;
(viii) that uniform burnishing of the drive piston inner conical form will occur rather than distinct burnished patches;
(ix) that when incorporated with a floating die shoe design, the press will operate consistently without locking of the die shoe cluster on the work piece; and
(x) that applications in step swaging where work piece diameters are reduced incrementally during repeated swaging operations, the additional rotation of the die shoe set provide an absolutely round resultant product shape.

It will of course be appreciated by those skilled in this art that further modifications of and improvements to the above described preferred embodiment can be readily made without departing from the scope of the invention defined in the annexed claims. For example, in one further possible embodiment, the die shoes 16 might be fixed in position other than their normal radial movement during a swaging operation and the drive piston 19 can be indexed about the rotational axis 29 by any desired angle of movement, typically in the range of 1 to 10 degrees. In such an embodiment, an indexing motor or other suitable drive means is provided to effect indexing rotation of the drive piston 19.

I claim:

1. A swaging press comprising:
an annular axially movable drive member;
a plurality of die shoes co: operable with said drive member; and
an actuator operable between said drive member and at least one of said plurality of die shoes,
wherein:
said drive member has at least one inwardly facing contact surface engageable with at least one outwardly facing segmented contact surface of each said plurality of die shoes,
said plurality of die shoes are configured as a die set whereby axial movement of said drive member in a first direction causes said plurality of die shoes of the die set to move radially inwardly during a swaging operation, and
said plurality of die shoes and said drive member are movable via the actuator relative to one another about a rotation axis after a single swaging operation or a number of swaging operations.

2. A swaging press according to claim 1, wherein said number of said swaging operations is a preset number greater than one.

3. A swaging press according to claim 1, wherein said relative rotation about said rotation axis occurs through a predetermined angle.

4. A swaging press according to claim 3, wherein said predetermined angle is between 1° and 10°.

5. A swaging press according to claim 3, wherein said predetermined angle is about 2.5°.

6. A swaging press according to claim 3, wherein said predetermined angle is between 2.0° and 5.0°.

7. A swaging press according to claim 1, wherein said plurality of die shoes move in the same direction about said rotation axis relative to said drive member.

8. A swaging press according to claim 7, wherein said actuator is activated by axial movement of said drive member during a swaging operation to cause each of said plurality of die shoes to move about said rotation axis.

9. A swaging press according to claim 8, wherein at least one connector is provided to link said plurality of die shoes of said die set together whereby when at least one die member of the plurality of die shoes is caused to move about said rotation axis, the remaining die shoes also move about said rotation axis.

10. A swaging press according to claim 8, wherein:
at least one of said plurality of die shoes comprises a recess;
said drive member comprises at least one annular ring surface, said annular ring surface including a ring of tooth formations,
said actuator includes an element with a formed outer end positioned in said recess in said at least one of said plurality of die shoes,
said element is urged, in use, in at least one of a radial outward direction or a radial rearward direction towards said drive member,
the formed outer end of the element is complementary in shape to the tooth formations of said ring of tooth formations on said drive member, such that axial movement of said drive member causes inter-engagement of said element with a respective one of said tooth formations of said ring of tooth formations to effect movement of the die shoes about said axis of rotation.

11. A swaging press according to claim 10, wherein said ring of teeth formations is located axially forward of said at least one frustoconical inwardly facing contact surface.

12. A swaging press according to claim 10, wherein:
said at least one frustoconical inwardly facing contact surface comprises at least two axially spaced frustoconical inwardly facing contact surfaces, and
said ring of tooth formations is located in a surface between said two axially spaced frustoconical inwardly facing contact surfaces.

13. A swaging press according to claim 1, wherein:
each of said plurality of die shoes has a forward end face with a generally radial extending guide formation,
a portion of said guide formations are substantially solely radial with at least one of said guide formations having a portion that is at least partially peripheral in direction with one or more radial portions,
the swaging press further comprises a pair of thrust rings overlying said forward end faces, one of said thrust rings having axially extending pins each being engaged by a said substantially solely radial guide formation, the other of said thrust rings having at least one axially extending pin engaged by a said guide formation having a portion that is at least partially peripheral in direction, and
each of said thrust rings has a peripheral ring of ratchet teeth with a cooperating ratchet member restraining each said thrust ring to rotate only in one direction about said rotation axis.

14. A swaging press according to claim 13, wherein each said guide formation is a groove or a slot formed in said forward end face of each of said plurality of die shoes.

15. A swaging press according to claim 14, wherein said plurality of die shoes are disposed such that said die shoes with substantially solely radial grooves or slots are interspaced by said die shoes with a said groove or slot with a portion that is partially peripheral in direction.

16. A swaging press according to claim 15, wherein said grooves or slots with a portion that is partially peripheral in direction has a Z format.

17. A swaging press according to claim 13, wherein at least some of said guide formations are grooves with a T cross-section, the axially extending pin adapted to cooperate with said groove with a T cross-section having a complementary pin and head shape.

* * * * *

UNITED STATES PATENT AND TRADEMARK OFFICE

CERTIFICATE OF CORRECTION

PATENT NO. : 9,283,613 B2
APPLICATION NO. : 14/120420
DATED : March 15, 2016
INVENTOR(S) : Van Essen It is certified that error appears in the above-identified patent and that said Letters Patent is hereby corrected as shown below:

In the Claims

Column 9

Line 44, “co:operable” should read --co-operable--

Signed and Sealed this
Seventh Day of June, 2016

Michelle K. Lee

Michelle K. Lee
*Director of the United States Patent and Trademark Office*